US005485800A

United States Patent [19]

Lob

[11] Patent Number: 5,485,800

[45] Date of Patent: Jan. 23, 1996

[54] RESILIENT STAND-UP DEVICE FOR BEARING BLOCK

[75] Inventor: Charles J. Lob, Oconomowoc, Wis.

[73] Assignee: Harken, Inc., Pewaukee, Wis.

[21] Appl. No.: 227,123

[22] Filed: Apr. 13, 1994

[51] Int. Cl.[6] ..... B63H 9/10

[52] U.S. Cl. ..... 114/204; 114/102; 114/218

[58] Field of Search ..... 114/102, 103, 114/112, 204, 205, 218, 364

[56] References Cited

U.S. PATENT DOCUMENTS 3,678,876 7/1972 Alter ..... 114/102

4,718,371 1/1988 Harken et al. ..... 114/364

*Primary Examiner*—Jesus D. Sotelo

*Attorney, Agent, or Firm*—Juettner Pyle Lloyd & Piontek

[57] ABSTRACT

A resilient stand up device for a pulley or block includes a hollow rigid fitting between the block and a support. The fitting has open jaws at each end, with one set of jaws disposed at right angles to the other, with attachment pins extending between the jaws. A compressible elastomer member is disposed in the fitting under compression. The fitting enables the block to be tilted in two directions, with the elastomer member providing a restoring force.

11 Claims, 2 Drawing Sheets

RESILIENT STAND-UP DEVICE FOR BEARING BLOCK

BACKGROUND OF THE INVENTION

This invention relates to resilient supports for objects such as bearing blocks for pulleys, and more particularly to a support for flexibly and resiliently supporting a bearing block from its base.

A conventional pulley comprises a head and side plates extending from the head. One or more rotatable sheaves are disposed between the side plates. The sheaves have outer peripheral grooves on which a flexible line is movably carried.

Pulleys or bearing blocks are extensively used on sailing vessels. The head of a block is usually attached to a support, such as to a deck, or to a car on a track. The blocks are typically attached by U-shaped fittings to allow freedom of movement as the block is being loaded by the line. In cases where the line alternatively becomes slack and tight, it is desirable to provide a resilient support to prevent the block from hitting surfaces near the support and to hold the block upright and to prevent line entanglement.

Proposals have already been made for resiliently supporting a block in an upright or vertical position relative to a support. Helical springs have been used for this purpose. Another device is shown in U.S. Pat. No. 4,718,371, which is a resilient cone-shaped device disposed between the base of the block and a support surface, with the cone extending around the attachment fittings.

SUMMARY OF THE INVENTION

The present invention provides the combination of a fitting and a self contained resilient member for attaching a block or similar working element to a support, such as a deck, a moveable car, or other object. The fitting is a hollow, substantially rectangular rigid member having open jaws at each end. The jaws at one end are arranged at right angles to the other, and pins extend between the jaws for rotary connection to the block at one end and connection to the support at the other. Thus, the block can rotate or tilt about perpendicular axes.

The resilient member is contained within the hollow rigid fitting under compression. The resilient member preferably comprises a pair of connected elastomer rings arranged at right angles and disposed in respective jaws. Also, an enlarged head may be formed at the top of the resilient member to receive and seat the head of a block.

The resilient member has a sufficient length such that it is placed under compression as the fitting is installed. The member acts as a partially compressed spring to retain the block in an upright position. Tilting of the block around each or both of the axes of rotation is resiliently resisted in a progressive manner.

The support of the present invention is considered highly advantageous over the prior art because it is compact and greatly minimizes, noise, shock, and possible damage to the block and surrounding parts due to the block flopping back and forth. Also, the support does not provide an exposed surface on which a line can be easily tangled.

DESCRIPTION OF THE PREFERRED EMBODIMENT

The device of the present invention is particularly suitable for use on sailing vessels, in which lines are used to control the rigging and sails. Pulleys or blocks are extensively used to control or change the direction of lines, and multiple pulley systems are employed to provide purchase or a mechanical advantage. In many cases, the angle or direction of entry of the line into the pulley changes under changing sailing conditions. Since pulleys or similar devices are usually mounted on relatively fixed supports, it is important that the body of the pulley be able to move freely with respect to the support. For example, a U-shaped eye strap on the head of the pulley is conventionally interengaged with an eye strap secured to a support, to allow a substantially universal degree of tilting of the pulley relative to the support.

Figure 1:
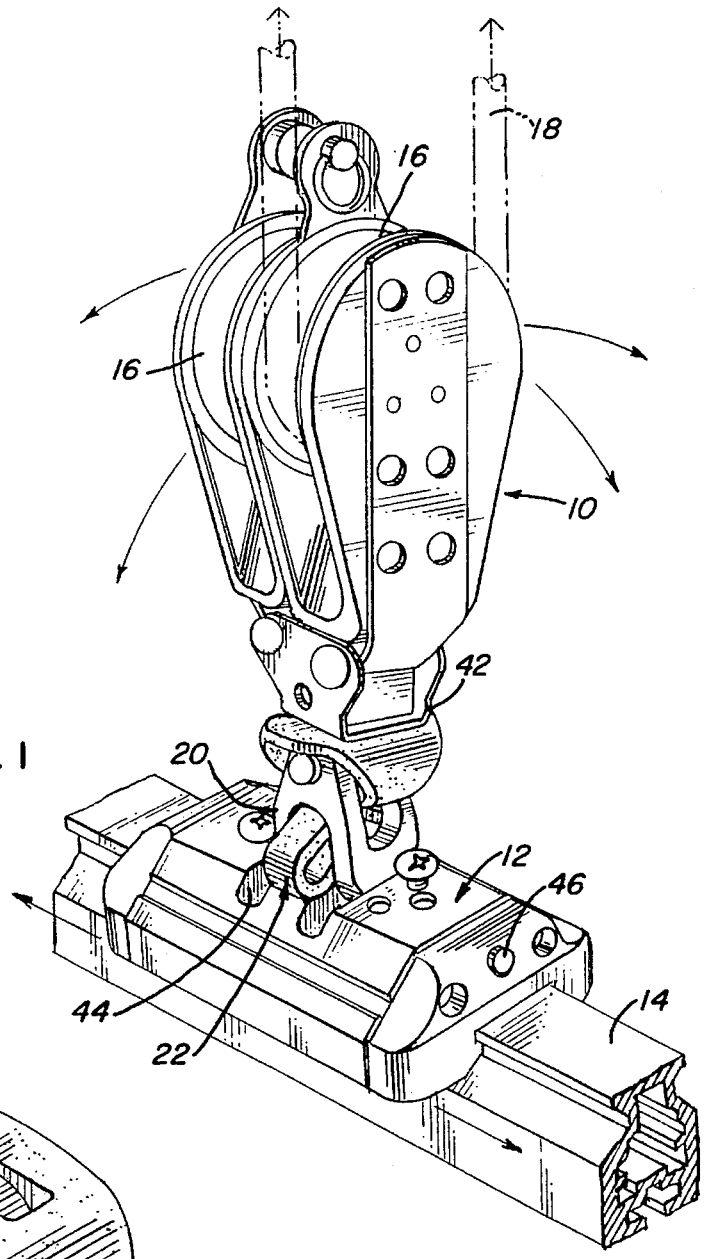
FIG. 1 is a perspective view of the resilient support of the present invention, shown in conjunction with a slidable traveler car and supporting a pair of bearing blocks in an upright position.

FIG. 1 shows an assembly wherein one or more pulleys or blocks 10 are connected to a traveler car 12 engaged with an elongated track, a portion of which is shown at 14. The track 14 is secured to a support, such as the deck of a boat, and the car is longitudinally slidable on the track to adjust the position of the block 10. The block 10 has a rotatable grooved sheave 16 which receives a line 18. The arrangement as shown is employed, for example, as part of a mainsheet system to control the boom and the mainsail of a sailboat.

As long as tension is applied to the line 18, the block 10 remains in an extended position relative to the car 12 and track 14. If the tension on the line 18 is abruptly released, or if the sail is flogging, the block 10 flops back and forth with considerable force and may also cause fouling of the line. Thus, resilient supports in the form of springs have been employed to resiliently hold the block or other working part in an upright position. The term "upright" is used in a relative sense and, as employed herein, shall be defined as a direction generally perpendicular to a part for structure from which the block is supported. For example, the block could be supported from either a horizontal, vertical, or angular surface.

As shown in FIGS. 1–4, the stand-up device of the present invention comprises a rigid joint or toggle 20 and a resilient member 22 which fits within the joint to provide resilient support. The joint 20 is of one piece rigid construction such as stainless steel comprising an opposed pair of outwardly facing open jaws 24 and 26, with one set of jaws being disposed or rotated perpendicular or at right angles to the other. As shown, the jaws are open at the ends and the sides. Aligned circular transverse openings 28 and 30 are provided through the respective jaw sets for the receipt of attachment pins, as described below, which pins are spaced and perpendicular to each other. The rigid member 20 is hollow and generally has a box shape, with open ends and four walls, each wall having a U-shaped opening at one end and a pin opening in the other end, in an alternating fashion around the box.

Figure 4:
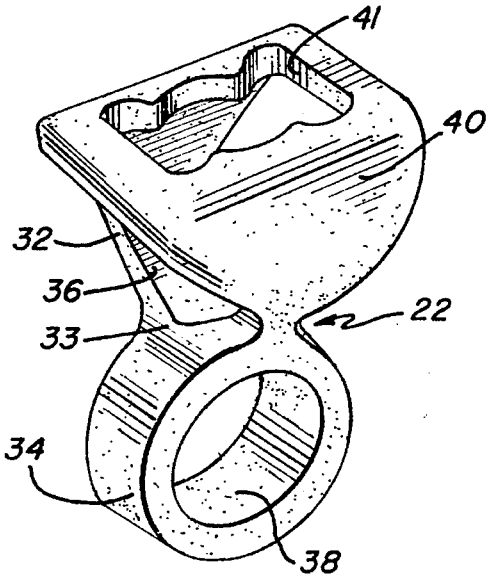
FIG. 4 is a perspective view of resilient support of the present invention.

The resilient member is shown in FIG. 4 in a relaxed condition and is preferably composed of an elastomer, such as urethane, or other synthetic rubber that is resistant to the elements.

The member 22 is preferably of one piece construction and comprises a pair of enlarged portions 32 and 34 connected by a common web 33. The enlarged portions are preferably in the form of hollow rings, with openings 36 and 38, with one of the rings being rotated at a right angle, and the rings being connected a tangent. The member 22 is sufficiently long to undergo partial compression during installation, such that the assembly is placed under resilient tension. Also, an enlarged head may be provided at the top of member 22 as shown, said head having an opening 41 to receive and cushion the head of the block, and to come into contact with the block and/or surrounding structure if pushed to one side.

Figure 2:
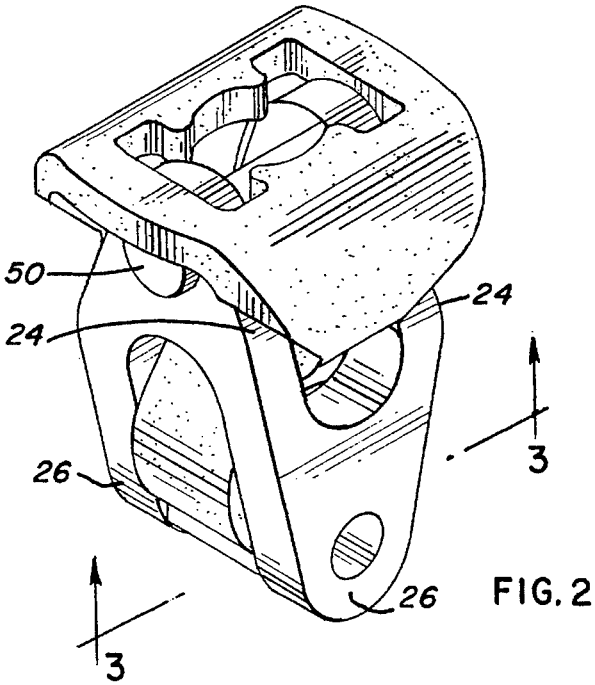
FIG. 2 is a perspective view of the assembly of a toggle joint and the resilient support of the present invention.
Figure 3:
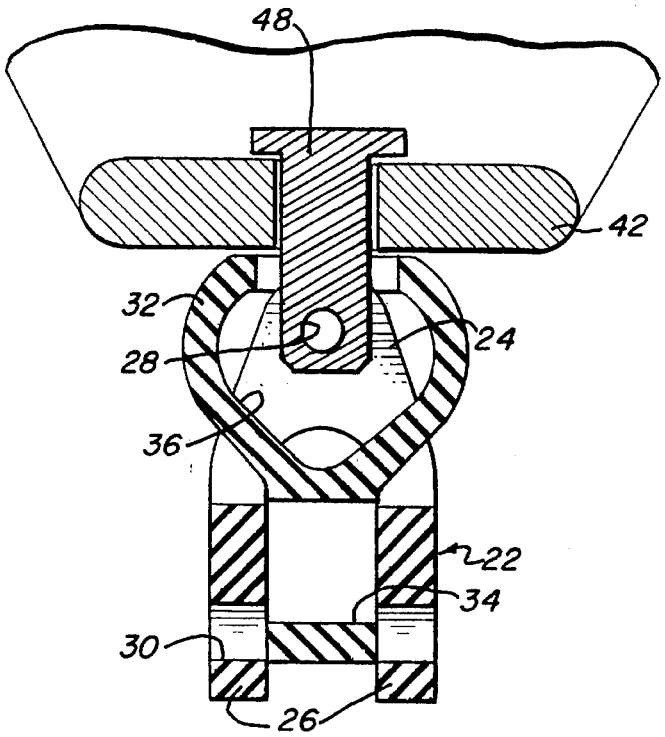
FIG. 3 is a sectional view taken along line 3—3 of FIG. 2, and additionally showing attachment to the head of a block.

The unit is assembled as shown in FIGS. 1–3 by first inserting the small end of the resilient member 22 into the open end of the toggle. The other end of the toggle is inserted into elongated parallel slots 44 in the car 12, and a pin 46 is inserted through an opening in the car and through the lower openings 30 of the toggle 20, to rotatably attach the toggle to the car. It will be noted that the lower portion 34 of the resilient member 22 is compressed against the top of the car by this process, such that the sides of member bulge out between the open jaws as shown in FIG. 1, thus acting as a compressed spring. The headpost 48 (FIG. 3) of the block, which has a transverse opening therethrough corresponding to opening 28, is inserted in the upper portion of the assembly, and the assembly is compressed sufficiently to bring the upper openings into alignment and allow insertion of the second pin 50 (FIG. 2) at right angles to the first. This causes the upper portion 32 of the resilient member to bulge out under compression between the upper jaws 24 when the unit is assembled.

When assembled, the resilient member 22 is under compression and acts as a continuous spring to hold the block 10 in an upright position relative to the car. If the forces on the line tend to bend the block in a direction around either one or both of the pins 46 and 50, such motion is permitted, but is resiliently resisted by the respective portions of the resilient member and in a progressive fashion. The assembly also cushions shocks and minimizes line tangles sometimes caused by exposed joints or springs.

I claim:

1. A device for resiliently mounting an object on a support, said device comprising a hollow rigid member having opposed pairs of outwardly open jaws, one pair of jaws being disposed at right angles to the other, a resilient member disposed in said hollow rigid member and between said jaws, and means between respective jaws for rotatably connecting respective jaws to said object and said support about substantially perpendicular axes, with said resilient member under compression, to resiliently retain the object in an upright position relative to the support, and to resiliently resist rotation about said axes.

2. The device of claim 1 wherein said resilient member is of one piece construction.

3. The device of claim 2 wherein said resilient member comprises a pair of connected enlarged portions.

4. The device of claim 2 wherein said resilient member comprises a pair of connected rings, with the axes thereof being substantially perpendicular.

5. The device of claim 1 wherein said resilient member is an elastomer.

6. The device of claim 1 wherein the jaws of said rigid member have open sides, and said resilient member is compressible and bulges out of said open sides.

7. The device of claim 1 wherein the means between respective jaws for rotatably connecting respective jaws to said object and support comprises a pin extending between each pair of jaws.

8. The device of claim 1 wherein said object is the head of a pulley.

9. The device of claim 1, wherein said rigid hollow member has four faces, alternating faces comprising an open groove at one end and a pin opening at the other end.

10. The device of claim 1 wherein said support comprises a movable car.

11. The device of claim 10 wherein said car has an upper surface, an internal pin in said car engaged with one end of said rigid member, and said flexible member engaging the upper surface of said car.

* * * * *